United States Patent [19]

Roberts

[11] 4,209,169

[45] Jun. 24, 1980

[54] WRIST-TO-RACKET ANGULATION AID FOR TENNIS PLAYERS

[75] Inventor: Kipton J. Roberts, Friday Harbor, Wash.

[73] Assignee: Dennis Grove, Friday Harbor, Wash. ; a part interest

[21] Appl. No.: 828,916

[22] Filed: Aug. 29, 1977

[51] Int. Cl.[2] ..... A63B 69/38

[52] U.S. Cl. ..... 273/29 A

[58] Field of Search ..... 273/29 A, 29 R, 73 R, 273/75, 191 B, 191 R, 183 B, 54 B, 188 R, 185 C, 189 B, 186 R, 190 B, 190 A, 192, 67 C, 194 R, 194 A, 35 R, 35 A, 193 A, 1 R; 128/134

[56] References Cited

U.S. PATENT DOCUMENTS

| | | | |
|---|---|---|---|
| 2,450,162 | 9/1948 | Promen | 273/189 R |
| 3,324,851 | 6/1967 | Posner | 273/189 R |
| 3,480,275 | 11/1969 | Jernstrom et al. | 128/134 X |
| 3,693,973 | 9/1972 | Wattenburg | 273/73 R |
| 3,858,881 | 1/1975 | Hurwitz | 273/73 R X |
| 3,880,426 | 4/1975 | Morse | 273/54 B |

FOREIGN PATENT DOCUMENTS

| | | | |
|---|---|---|---|
| 2449360 | 4/1976 | Fed. Rep. of Germany | 273/29 A |
| 205442 | 10/1923 | United Kingdom | 273/29 A |
| 281171 | 12/1927 | United Kingdom | 273/189 R |

*Primary Examiner*—Richard C. Pinkham
*Assistant Examiner*—T. Brown
*Attorney, Agent, or Firm*—Christensen, O'Connor, Johnson & Kindness

[57] ABSTRACT

To assist a tennis player in maintaining a proper grip on the handle of a tennis racket, a training aid is disclosed which includes a wristband, a racket-handle band and interconnectable strap segments separately attached to such bands for tethering the racket handle to the wrist to force the player to hold the head of the racket above the wrist, and thus forcing the handle of the racket to assume a proper angle with respect to the player's forearm. The strap segments are provided with interconnectable/separable fabric fasteners, such as commercially available "Velcro" (a trademark) fastening strips for quick and easy connection and separation using the hand that is not holding the racket, and the bands and strap segments are made of a lightweight material which does not add perceptible weight to the racket or to the player's wrist, permitting the player to wear the training aid without discomfort or interference.

3 Claims, 3 Drawing Figures

WRIST-TO-RACKET ANGULATION AID FOR TENNIS PLAYERS

BACKGROUND OF THE INVENTION

The invention pertains to training aids and devices that provide a restraint between the player's forearm or wrist and the handle of a tennis racket for aiding the player in holding the racket handle at a proper angle with respect to the player's forearm.

One of the most common faults of beginning and amateur tennis players is to let the head of the racket droop with respect to their wrist so that the racket handle becomes essentially aligned with the player's forearm resulting in a weak, sometimes called "wristy" stroke of the ball. The proper way to grip the racket handle is to hold the racket head elevated with respect to the wrist, which may also be described as maintaining a less than 180° angle between the racket handle and the player's forearm. The resulting angulation causes the racket handle, wrist and forearm to act as a somewhat rigidified unit when stroking the ball, thereby affording greater control over the racket, especially during the follow-through after the racket impacts with the ball.

The above mentioned fault of beginning players has been recognized and efforts have been made to provide corrective or training devices for assisting student players in maintaining a proper grip of the racket. For example, in U.S. Pat. No. 3,693,973 such a device is disclosed which includes a bulky cuff member that is strapped to the player's forearm and has rigid, angulated rods protruding from its forward end to a special attachment on the butt end of the racket handle. The device does force the player to maintain a proper angulation of the racket handle relative to the forearm, its' weight, bulkiness and rigidity limit use of the device, for the most part, to nongame training situations, inasmuch as it is impractical or at least very difficult to use during actual practice games and recreational play. If the device were worn during an actual game situation, it would adversely interfere with certain phases of the game, such as the player's service, and yet the device cannot be quickly or easily taken off or put back on. Furthermore, the angle at which the racket is held with respect to the forearm is fixed by the rigid bend in the rods that extend from the forearm cuff, and the angle thus cannot be adjusted for each individual player, nor can it be adjusted during play as may be desired for different game situations or different strokes.

A related tennis aid, illustrated in U.S. Pat. No. 3,858,881, comprises a cuff worn on the player's forearm and connected to the racket handle by an elastically stretchable cord. The device is primarily intended to relieve the strain on a player's forearm that results in or aggravates a soreness known as "tennis elbow." Incidental to this main purpose, the device is also stated to have the advantage of assisting a beginning player in maintaining a proper angle between the racket handle and the forearm. The cuff or band is adapted to be worn around the player's forearm approximately midway between his wrist and elbow. When worn in this position, the disclosed device is said to be most effective for relieving the so called "tennis elbow." But, to wear the cuff at this location and hold it in place, requires the cuff to be secured tightly around the forearm. The cord which extends between the forearm cuff and the racket handle is made of a very stretchable material, such as the commercially known "Bungee" (a trademark) cord, that can and will stretch whenever a player reverts to a faulty grip and causes the racket head to droop. While the stretchability of the restraining cord may be desirable to achieve the primary purpose of the device, that is to prevent or relieve "tennis elbow". Also, while the disclosed stretchable cord is detachably connected to the cuff by a snap hook, it is evident from the construction and arrangement of the cord and the snap hook that it is not intended, nor is it practical, to disconnect the cord from the cuff and continue play because the cord and hook dangling from the point of attachment on the racket handle will surely interfere with the player's concentration. Thus, to disconnect the device, play must be suspended while the looped end of the cord is removed from the racket handle.

Accordingly, it is an object of the invention to provide a tennis training aid of the general type characterized above, but which overcomes one or more of the above discussed disadvantages of devices previously proposed for this purpose.

It is a more particular object of the present invention to provide a wrist-to-racket training aid for assisting a player in maintaining the proper angle between the racket handle and his forearm and which is characterized by being extremely lightweight and of such small size that it is neither uncomfortably heavy nor bulky when placed on the wrist and racket handle, and is quickly unfastenable and refastenable without suspending play, and is designed so that is can be unfastened to release a connection between the wrist and racket handle when desired, such as during a player's service, while permitting unencumbered play to continue with one portion of the device retained on the player's wrist and another portion retained on the racket handle, ready for instant refastening when the angulation aid is thereafter needed.

Still another object of the invention is to provide such a wrist-to-racket angulation aid which can be inexpensively manufactured so that the ultimate product can be sold at such a low cost that it will be affordable by amateur and recreational tennis players, and yet be sufficiently durable and long-lasting to withstand the strains of many hours of active tennis play.

SUMMARY OF THE INVENTION

The training aid of the invention comprises a wristband, a racket-handle band and a pair of strap segments each having one end permanently attached to a separate one of the bands and having their opposite unattached ends provided with interconnectable and separable fabric fastening means, such as commercially available "Velcro" (a trademark) fastener strips. The wristband and its attached strap segment are worn on the player's wrist, while the racket-handle band is snugly fastened about the racket handle immediately above the handle grip and its strap segment projecting rearwardly along the grip toward the butt end of the racket. The racket handle is gripped by the hand wearing the wristband and the strap segments are overlapped and pressed together to form a strap of adjustable length tethering the wristband to the racket-handle band and causing the racket handle to assume and maintain a proper angle with respect to the player's forearm. The fabric fastening means provided on the strap segments permits the player to quickly unfasten and refasten the strap segments with his opposite hand without suspending play. The bands and strap segments are made of lightweight pliable material which results in a device that can be worn and played with comfort and effectiveness, whether the strap segments are fastened or unfastened, the latter of which may be desired during the player's service.

Preferably both the wristband and the racket-handle band are provided with fabric fastening means similar to that used on the strap segments so that the bands can be adjusted to the size of each individual's wrist, and each different racket handle, enabling a snug fit in all cases.

To provide a complete disclosure of the invention, reference is made to the appended drawings and the following description of one particular and preferred embodiment.

DESCRIPTION OF THE PREFERRED EMBODIMENT

Figure 1:
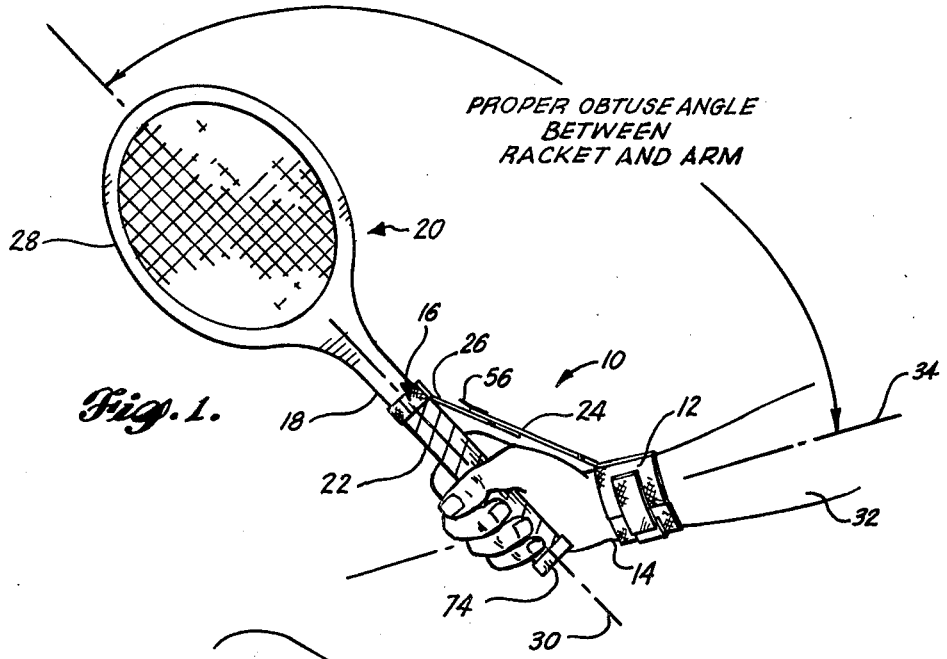
FIG. 1 illustrates the wrist-to-racket angulation aid of the invention as it is used by a player to assist in gripping the handle of the racket so as to maintain a proper angle between the racket handle and the player's forearm.

With reference to FIG. 1, the wrist-to-racket training aid 10 includes a wristband 12 removably secured about the wrist 14 of the player; a similar but smaller band 16 removably secured about a handle 18 of racket 20 adjacent an upper end of grip 22; and a pair of interconnectable strap segments 24 and 26 separately affixed to wristband 12 and racket-handle band 16, respectively. Strap segments 24 and 26, when fastened together in the overlapping fashion illustrated in FIG. 1, tether wristband 12 to racket-handle band 16 and thereby cause the head 28 of racket 20 to be held above the level of the player's wrist 14. More specifically, aid 10 places a limit on the maximum obtuse angle that can be formed between a lengthwise axis 30 of racket handle 18 and a lengthwise axis 34 of the player's forearm 32.

Figure 2:
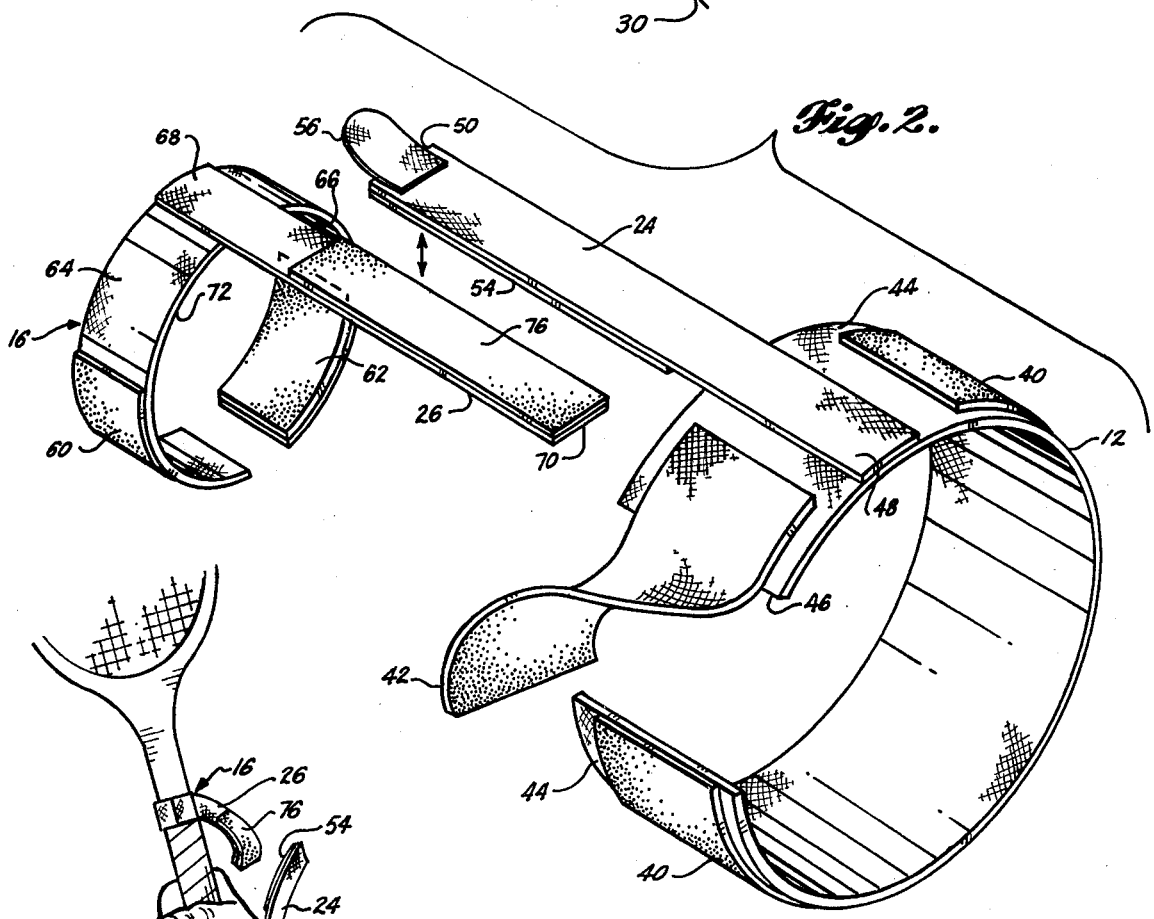
FIG. 2 is an enlarged view of the wrist-to-racket angulation aid of FIG. 1 shown with the racket-handle band untethered from the wristband.

With reference to FIG. 2, wristband 12 is made of a lightweight pliable material such as leather, cloth, a soft plastic, or the like, having a length suitable for wrapping completely or substantially about a person's wrist. The width of band 13 should be selected to provide sufficient frictional contact with the wrist so as not to slide up the forearm or down onto the hand and for this purpose a width in the range of $\frac{3}{4}$ of an inch to $2\frac{3}{4}$ inches is suitable.

For securing the band 12 in place, complementary fabric fastening strips 40 and 42 are attached circumferentially to outer surface 44 (or in a lengthwise fashion if band 12 were laid out flat) using suitable fastening means such as stitching or gluing or any other technique that allows band 12 and strips 40 and 42 to remain pliable. Strips 40 and 42 together form a separable fabric fastener, an example of which is commercially available under the trademark "Velcro," and which is characterized by complementary inter-engaging synthetic fabric facings, one of which is a facing of raised fiber loops and the other of which is a facing of raised fiber hooks. While not essential, the looped facing may be provided by strip 40, with the facing on the outer surface of the strips, and the complementary hooked facing provided on the inner surface of strip 42. Strips 40 and 42 may be arranged on band 12 in any suitable manner that enables the respective inner and outer facings to be brought into overlapping contact when band 12 is placed about the player's wrist.

Strap segment 24 is also of a lightweight pliable material, such as cloth. One end 48 of strap segment 24 is attached to the outer surface 44 of band 12 so that segment 24 extends crosswise to the length of band 12 and the unattached end 50 projects transversely outwardly from an edge 52 of the band. Band 12 is placed on the wrist with edge 52 adjacent the hand so that the thusly affixed strap segment 24 projects forwardly from band 12 along the top of the wrist, i.e., along a line generally bisecting the joint between the thumb and index finger. The downwardly facing surface of segment 24 is provided with a strip 54 of one of the complementary facings of a separable fabric fastener of the type described above in connection with fastening strips 40 and 42. In practice, segment 24 and strip 54 may be provided by an integrated strip of fabric fastening material in which a cloth backing for the facing (either raised loops or hooks) serves as strap segment 24 and is sewn directly onto band 12. A tab 56 of cloth or leather may be provided on the unattached end of segment 24 to facilitate the unfastening of the segments 24 and 26.

Racket-handle band 16 is similar to wristband 12, although smaller in both circumference and width. The length should be adequate to extend substantially or fully around handle 18 and the width should provide sufficient frictional or gripping contact with the racket handle to hold band 16 in place. As in the case of wristband 12, the fastening means for band 16 is also provided by complementary fabric fastening strips 60 and 62 of the type described above. Strips 60 and 62 are circumferentially arranged on band 16 and secured to its outer surface 64 and inner surface 66, respectively, by suitable means as discussed above in connection with strips 40, 42 and band 12, and are positioned so that strip 60 can be overlapped by strip 62 when placed about racket handle 18.

Strap segment 26 has a length and a width matching those of strap segment 24 and forms the complement thereof with one end 68 of segment 26 being attached to band 16 so that the length of segment 26 extends crosswise with respect to the length of band 16 (when the latter is laid out flat). The opposite and unattached end 70 of segment 26 projects transversely outwardly from an edge 72 of band 16 such that when band 16 is mounted on racket handle 18 with edge 72 lying adjacent grip 22, end 70 of segment 26 projects rearwardly along grip 22 toward a butt end 74 of the handle as shown in FIG. 1. An upper surface of strap segment 26 is provided with a fabric fastening strip 76 that is the complement of strip 54. Strip 76 is arranged lengthwise on strap segment 26 and as in the case of segment 24, these separate elements may be provided by an integrated cloth backing and fastener facing which may be attached directly to band 16.

Figure 3:
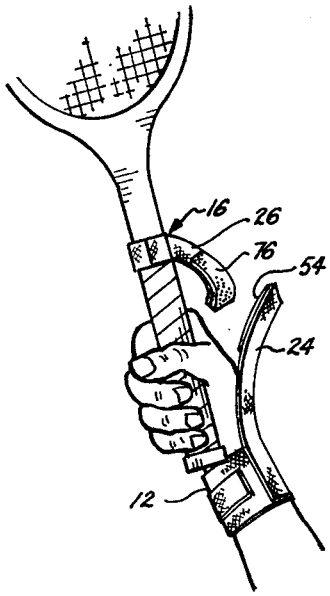
FIG. 3 is a fragmentary view, similar to FIG. 1, showing how the components of the training aid of FIG. 2 can be unfastened and left in place on the racket handle and wrist, respectively, while play continues without interfering with or distracting the player.

The lengths of strap segments 24 and 26 are sufficient to enable an inch or more overlap between strips 54 and 76 when arranged and fastened together as shown in FIG. 1. The exact amount of overlap will vary depending upon the length of the desired tethering between bands 12 and 16 as described more fully below. However, a minimum overlap of approximately one inch is needed to provide adequate holding force between the engaged fastening strips 54 and 76. The strap segments should not be any longer than needed for the above purpose so that when unfastened as shown in FIG. 3, the freed segments do not unduly flap around and interfere with the player's game. For this purpose, the total tethering length of the joined strap segments is preferably shared equally by the lengths of the two segments so that neither segment is so long, that when unfastened as shown in FIG. 3, it will disturb the player. Thus, substantially equal length segments are preferred, and a suitable length, measured from edges 52 and 72 to the unattached ends 50 and 70, respectively, is within the range of around 2½ inches to 4½ inches.

USE OF TRAINING AID 10

Bands 12 and 16 are separately fastened to the wrist and racket handle while segments 24 and 26 remain separated. Wristband 12 is oriented on the wrist such that strap segment 24 projects forwardly generally along a line bisecting the joint between the thumb and index finger, or in other words along the top part of the player's wrist. Band 16 is fastened snugly about handle 18 adjacent the upper end of grip 22 where a slight shoulder formed between the circumference of handle 18 and the somewhat larger circumference of grip 22 will restrain band 16 from being pulled downwardly onto grip 22. Band 16 is rotated on the racket handle to align segment 26 with the narrow surface portion of grip 22. The player now grasps grip 22 and rotates the grip within his hand until the strap segments are lined up which will automatically orient racket 20 to a proper position with respect to the player's hand and wrist.

The player now uses his opposite hand to more precisely line up strap segments 24 and 26, and to press the segments together to fasten strips 54 and 76 and thereby set the tethering length between the wristband 12 and racket-handle band 16. The tethering length is selected to be short enough to hold head 28 of racket 20 up above the level of the player's wrist 14. More particularly, the length of the fastened strap segments is set to limit the maximum obtuse angle that the lengthwise axis 30 of racket handle 18 can make with respect to the lengthwise axis 34 of the player's forearm 32 as shown in FIG. 1. Any relaxation of the grip on racket 20 which would cause head 28 to droop and thus result in a weak, wristy shot, is prevented as the tether formed by fastened strap segments 24 and 26 will become taut, constraining the racket to the position shown in FIG. 1. The proper racket angulation is consistently maintained during volleying, regardless of body position, because of the fixed tethering length of the joined strap segments 24 and 26.

The proper obtuse angle between axes 30 and 34 will, of course, vary depending upon the player, the game situation and many other factors. Such variation is quickly and easily achieved by separating strap segments 24 and 26, using tab 56 to strip segment 24 from segment 26, and thereafter moving the racket to the desired angular orientation and refastening segments 24 and 26, without ever suspending play.

In some game situations, such as during a player's service, the constraint provided by training aid 10 may be unwanted. In such case, the player merely separates segments 24 and 26, again using tab 56, and leaves wristband 12 and racket-handle band 16 in place and continues play as shown in FIG. 3.

Since the strap segments are constructed of lightweight pliable material and use fabric fastening means rather than metal clasps, snaps, snap hooks, or the like, and because the segments are relatively short due to their sharing of the total tethering length, training aid 10 can be worn in the unfastened state, as shown in FIG. 3, without distracting the player. When aid 10 is again needed, segments 24 and 26 are quickly and easily refastened, without requiring the suspension of play.

Also, because of the nature of the materials used in training aid 10, and because of its configuration, the device, does not add perceptible weight or bulkiness to the wrist or racket handle and thus does not encumber the player's stroke in any way other than to establish the proper racket-to-arm angulation. Furthermore, the device does not interfere with a two-handed backhand stroke.

While only a particular embodiment has been disclosed herein, it will be readily apparent to persons skilled in the art that numerous changes and modifications can be made thereto without departing from the spirit of the invention. For example, while the use of fabric fastening means on strap segments 24 and 26 is essential to the invention for the reasons discussed above, this is not so with respect to the use of this type of fastening means on wristband 12 and racket-handle band 16. Since these bands can be put on and left in place during play as suggested above, it is not as essential that they be as quick and as easy to fasten and unfasten, as in the case of strap segments 24 and 26. Thus, while the fabric fasteners are used in the preferred embodiment for bands 12 and 16, if desired other types of fasteners may be used therefor while still realizing the objectives of the invention. For example, bands 12 and 6 could be fastened by a buckle of the type used on a wristwatch band, or by other suitable means so long as the weight and bulkiness of the substitute fasteners are kept to a minimum.

The embodiments of the invention in which an exclusive property or privilege is claimed are defined as follows:

1. A wrist-to-racket training aid for assisting a tennis player in holding the racket at a proper angle with respect to the forearm, comprising:

a wristband made of pliable material and having means for removably fastening said wristband snugly about the wrist of a tennis player;

a racket-handle band having means for removably fastening such racket-handle band snugly about the handle of a tennis racket at a location adjacent the upper end of a grip on such handle;

first and second strap segments of pliable material for tethering said racket-handle band to said wristband, said first strap segment having one end so attached to said wristband so that its unattached end projects transversely outwardly from an edge of said wristband and so that when said wristband is fastened to the wrist of a player said first strap segment extends forwardly from said wristband adjacent the thumb and index finger of the player's hand, and said second strap segment having one end so attached to said racket-handle band so that its unattached end projects transversely outwardly from an edge of said racket-handle band and so that when said racket-handle band is fastened to a racket handle at said location said second strap segment extends rearwardly therefrom toward the butt end of such racket handle; and, interconnectable and separable fabric fastening means provided on said first and second strap segments for releasably and adjustably fastening said first and second straps when the unattached ends thereof are pressed together in overlapping relation to form a tether of selected fixed length between said wristband and said racket-handle band, such that when said wristband and racket-handle band are fastened to a player's wrist and racket handle, respectively, said tether limits the maximum obtuse angle that the racket handle can make relative to the player's forearm; and, said first and second strap segments and fabric fastening means being of such size, construction and arrangement that a player can quickly unfasten and refasten said strap segments with his or her opposite hand without suspending play, and so that when so unfastened said strap segments do not interfere with continuing play.

2. The wrist-to-racket training aid of claim 1, wherein said first and second strap segments are of substantially equal length so that each of said strap segments is of minimal length and does not, when unfastened from the other strap segment and thus loose, interfere with the physical movement and mental concentration of the player.

3. The wrist-to-racket training aid of claim 1, wherein said releasable fastening means of said wristband and racket-handle band comprise interconnectable and separable fabric fastening means.

* * * * *